US006419543B1

(12) United States Patent
Burrows

(10) Patent No.: US 6,419,543 B1
(45) Date of Patent: Jul. 16, 2002

(54) THREE-DIMENSIONAL SURFACE TREATMENT FOR A BOOK

(75) Inventor: Roger I. Burrows, Southport, CT (US)

(73) Assignee: Sandvik Innovations LLC, Bristol, PA (US)

( * ) Notice: Subject to any disclaimer, the term of this patent is extended or adjusted under 35 U.S.C. 154(b) by 0 days.

(21) Appl. No.: 09/261,533

(22) Filed: Mar. 3, 1999

(51) Int. Cl.[7] ..... A63H 33/22; A63H 33/38

(52) U.S. Cl. ..... 446/219; 446/147; 428/195; 281/51; 281/29

(58) Field of Search ..... 446/147, 219, 446/485, 220, 226; 428/195, 156; 281/51, 29, 37; 492/70, 73; 283/63.1

(56) References Cited

U.S. PATENT DOCUMENTS

| | | | | |
|---|---|---|---|---|
| 1,711,330 A | | 4/1929 | Simon | |
| 2,718,484 A | | 9/1955 | Baroumes | 154/106 |
| 3,061,500 A | | 10/1962 | Kreier, Jr. | 156/245 |
| 3,444,032 A | | 5/1969 | Kreier, Jr. | 161/18 |
| 3,580,768 A | | 5/1971 | Kukla | 156/156 |
| 3,629,034 A | | 12/1971 | Kuroda | 156/219 |
| 3,694,296 A | | 9/1972 | Frontino | 161/18 |
| 3,695,982 A | | 10/1972 | Brody | 161/5 |
| 3,758,358 A | | 9/1973 | Kuroda | 156/222 |
| 3,796,622 A | | 3/1974 | Brody | 156/245 |
| 3,950,477 A | | 4/1976 | Di Giacomo | 264/226 |
| 4,160,685 A | | 7/1979 | Kuroda | 156/219 |
| 4,226,902 A | * | 10/1980 | Webb | 446/220 X |
| 4,239,824 A | | 12/1980 | Kasten | 428/13 |
| 4,280,241 A | | 7/1981 | Pfaff | 11/1 R |
| 4,341,443 A | | 7/1982 | Robinson | 350/98 |
| 4,397,701 A | | 8/1983 | Johnson et al. | 156/62 |
| 4,480,293 A | | 10/1984 | Wells | 362/108 |
| 4,514,175 A | | 4/1985 | Zaruba et al. | 434/82 |
| 4,585,684 A | | 4/1986 | Mackarous | 428/79 |
| 4,659,919 A | | 4/1987 | Price | 250/209 |
| 4,683,588 A | | 7/1987 | Goldberg | 381/61 |
| D292,597 S | | 11/1987 | Gifford et al. | D19/27 |
| 4,709,307 A | | 11/1987 | Branom | 362/103 |
| D295,538 S | | 5/1988 | Stajan et al. | D19/59 |
| 4,774,434 A | | 9/1988 | Bennion | 313/500 |
| 4,819,963 A | | 4/1989 | Wolski | 281/15.1 |
| 4,823,240 A | | 4/1989 | Shenker | 362/103 |
| 4,847,026 A | | 7/1989 | Jarboe et al. | 264/467 |
| 4,853,994 A | | 8/1989 | Ekstein | 5/437 |
| 4,874,340 A | | 10/1989 | Smallwood | 446/28 |
| 4,909,542 A | | 3/1990 | Marks | 281/15.1 |
| 4,940,558 A | | 7/1990 | Jarboe et al. | 264/46.7 |
| 5,033,985 A | * | 7/1991 | Nahas | 446/226 X |
| 5,067,925 A | | 11/1991 | West | 446/397 |
| 5,169,701 A | | 12/1992 | Sander | 428/79 |
| 5,233,845 A | | 8/1993 | D'Andrade | 63/2 |
| 5,255,834 A | | 10/1993 | Bendersky | 224/209 |
| 5,345,705 A | | 9/1994 | Lawrence | 40/616 |
| D357,937 S | | 5/1995 | Ho | D19/60 |
| 5,439,538 A | | 8/1995 | Perry | 156/63 |
| 5,575,098 A | | 11/1996 | Goettel-Schwartz | 40/550 |
| 5,746,637 A | | 5/1998 | Hunt | 446/72 |
| 6,153,311 A | * | 11/2000 | Springer et al. | 428/542.2 |
| 6,237,294 B1 | * | 5/2001 | Rygiel | 428/195 X |
| 6,270,877 B1 | * | 8/2001 | Sloot | 428/195 X |

* cited by examiner

*Primary Examiner*—D. Neal Muir
(74) *Attorney, Agent, or Firm*—Drinker Biddle & Reath LLP

(57) ABSTRACT

A three-dimensional surface treatment which can be applied to or supported by a substrate is provided for covering a book. The surface treatment comprises at least one three-dimensional member made from plastic having an outer surface, an inner surface and a border. The outer surface is sculpturally molded into a three-dimensional sculpture-in-the-round, having peaks, impressions, relieved areas and undercuts in all axes to increase the overall dimensionality and detail of the surface treatment. In the preferred embodiment, multiple three-dimensional members may be used, wherein each three-dimensional member serves as a separate layer that forms part of the overall three-dimensional appearance of the surface treatment. In addition, interactive devices may be embedded in the three-dimensional members in order to make the surface treatment interactive.

29 Claims, 11 Drawing Sheets

THREE-DIMENSIONAL SURFACE TREATMENT FOR A BOOK

FIELD OF THE INVENTION

The present invention relates generally to a three-dimensional surface treatment. In particular, the present invention relates to a three-dimensional surface treatment that forms a cover for a book.

BACKGROUND OF THE INVENTION

Two-dimensional displays are often used to market toys, games, books, and the like for children. Two-dimensional displays frequently include pictures, words, patterns, symbols and other types of graphic images that are specifically designed to appeal to the interest of children. The graphic images are used to thematically represent or imitate real objects or people. In some cases, two-dimensional displays, toys, games and books marketed for children have been given surface treatments to enhance the appearance of the particular product. The surface treatments attempt to create an image having depth and dimensionality when observed from all sides. For instance, surface treatments such as fabric can be cut into a particular shape or design and then filled with relatively soft filler material. The filler material gives the fabric a three-dimensional appearance. In addition, the texture of the fabric encourages children to touch and feel the surface treatment. In some cases, pictures, designs and other form of illustrations are printed on the fabric to appeal to the visual interests of children.

Embossed images have also been used as a surface treatment to create objects having a three-dimensional appearance. The embossed images are frequently made from rigid material and are generally formed into very simple abstract shapes. A typical example of an embossed image is the face of a coin, such as a penny or a dime. Embossed images have been also incorporated into covers for children's books to create a three-dimensional appearance. Although embossed images are more attractive than conventional two-dimensional designs, such images still lack sufficient undercuts or relived surfaces that are present in most real three-dimensional objects. Indeed, undercuts and relieved surfaces add to the dimensionality of a particular display and permit the presentation of features which are not present in embossed images. Moreover, the rigid material used to create embossed images is not very appealing to children.

Accordingly, many surface treatments fail to capture a true three-dimensional appearance. Indeed, surface treatments used in products manufactured and marketed for children, such as a cover for a book as one example, often lack any significant three-dimensional appearance and fall short of capturing the attention of children. To be effective, the three-dimensional surface treatment must create very detailed images and shapes having sufficient dimensionality when observed from all sides to provide a sculpture-in-the-round appearance. Furthermore, the three-dimensional surface treatment should not only create an image or object having a three-dimensional sculpture-in-the-round appearance, it should also have tactile characteristics that will appeal to children.

SUMMARY OF THE INVENTION

The present invention relates to a three-dimensional surface treatment can be molded in the form of a cover for a book or adhered to a portion of a substrate. The surface treatment comprises at least one three-dimensional member that is formed as part of the material used to cover a portion of the book. The three-dimensional member is made from flexible plastic material, such as vinyl. The three-dimensional member includes an outer surface, an inner surface adhered to the book, and a border. The outer surface is sculpturally formed into a three-dimensional design having predetermined detail, texture, and undercuts in all axes to create a sculpture-in-the-round. The outer surface can be colored or coated to further enhance the three-dimensional appearance of the surface treatment. In the preferred embodiment, multiple three-dimensional members are used to form individual layers that are joined together to form the three-dimensional surface treatment. Each layer can be used to support interactive elements.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
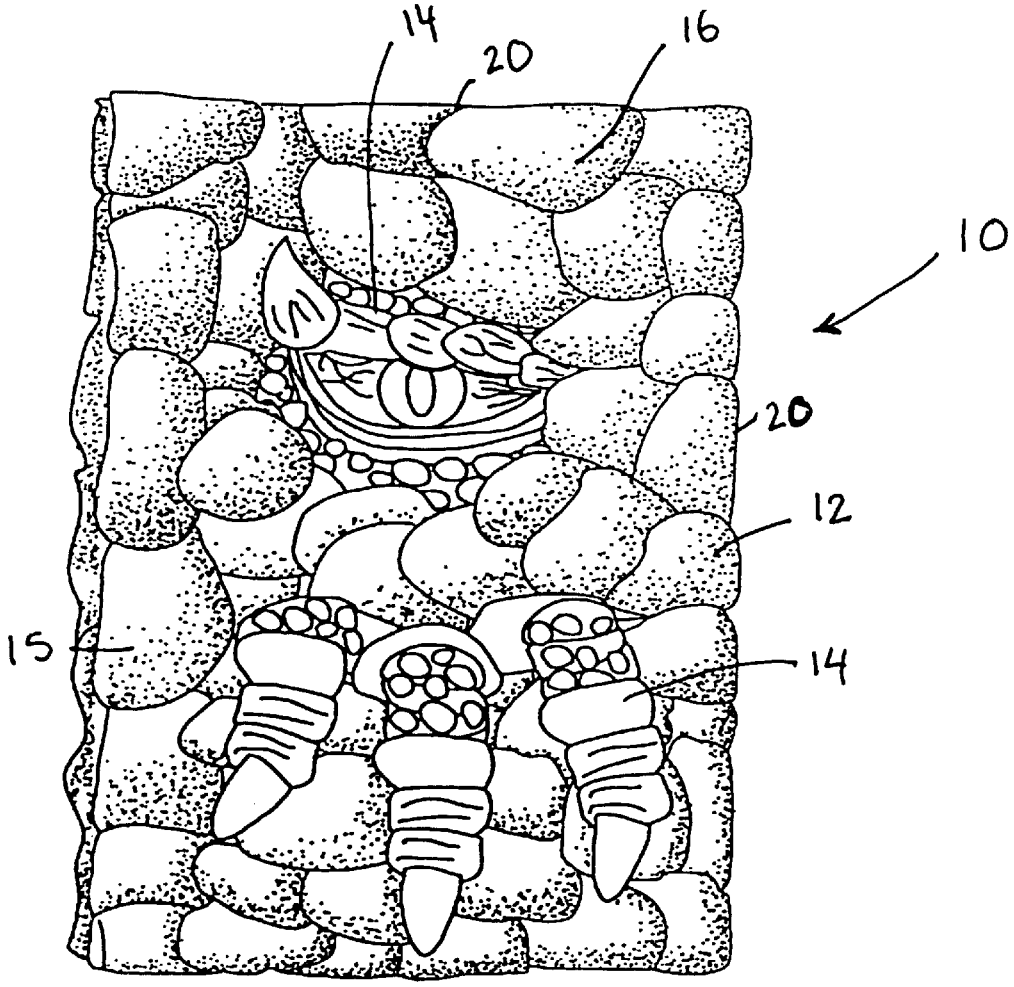
FIG. 1 is a front view of a preferred embodiment of a three-dimensional surface treatment in accordance with the present invention, shaped in the form of a cover for a book.

In the drawings, where like numerals identify like elements, there is shown in FIG. 1 a three-dimensional surface treatment which is generally referred to by the numeral 10. The surface treatment 10 may be adhered to any type of substrate. The substrate can be made from any type of material such as paper, plastic, wood, metal, fabric, or the like. Also, the substrate may be adopted in any form, such as a book, a poster, a gift card, point of sale packaging, displays or the like. In the preferred embodiment, as discussed below, the surface treatment 10 is applied to a substrate adapted in the form of a book.

The surface treatment 10 comprises at least one three-dimensional layer or member 12, although multiple three-dimensional members are preferred. The three-dimensional member 12 can be used to support one or a plurality of three-dimensional inserts 14 which contribute to the three-dimensional appearance of the surface treatment 10.

The surface treatment 10 is made from plastic material, although any type of material can be used. The plastic material can be selected from a group comprising polypropylene, polystyrene, polyvinlychloride ("PVC"), polyurethane, ABS plastics, rubber, rubber silica, and other types of pliable material. In use, the plastic material is molded or formed into desired three-dimensional shapes or images using generally known techniques that create a three-dimensional sculpture-in-the-round. Plastic material having a durometer in the range from about 10 (which is very soft) to as high as 100 (which is relatively hard) can be used with the present invention. Accordingly, the tactile characteristics of the three-dimensional surface treatment can be advantageously changed by manipulating the durometer of the plastic material. It should be understood that plastic material having any durometer may be used in keeping with the present invention.

In general, relatively soft plastic material produces better results, although the invention is not exclusively limited to soft plastic material. Soft plastic material is typically more easily molded and sculpted into a three-dimensional surface treatment using simple and inexpensive processes such as pour casting, molding, thermoforming or the like. Furthermore, soft plastic material can be shaped with molds having very intricate and complex designs, giving the resulting surface a high degree of detail. As an added benefit, soft plastic material is more appealing to children, when compared with rigid plastics. For example, as contemplated by the present invention, the surface treatment 10 can be molded to represent rocks or metal objects, using soft plastic material that is painted or coated to look like a rock or metal. As a result, children will be attracted to the ability to feel the soft material of the surface treatment 10, yet visually experience a rock or a metal object. This feature of the present invention cannot be achieved if the plastic material is too rigid. In the present invention, vinyl is preferred.

Multiple three-dimensional members 12 may be advantageously used to form the surface treatment 10 to create true sculpture-in-the-round images or a more realistic display. That is, each three-dimensional member 12 can be molded using the techniques discussed above to have its own three-dimensional appearance. Once formed, each three-dimensional member 12 can form a separate layer that is part of the overall three-dimensional appearance of the surface treatment 10. Multiple three-dimensional members 12 allow any three-dimensional scene or object to be represented by one or more three-dimensional members 12. Thus, very intricate designs having complex parts can be formed into a surface treatment 10 using multiple three-dimensional members 12.

Multiple three-dimensional members 12 also provide a significant advantage in that each layer can be molded or cast in a different material and variations of similar materials. Because different materials may be used, each three-dimensional member 12 can have a different type of texture, appearance or tactile characteristics. Moreover, using different material can be advantageously used to reduce the overall manufacturing cost of the surface treatment 10 by permitting lower cost material to be used.

Moreover, multiple three-dimensional members 12 may be used to support non-electric or passive interactive devices. The passive interactive devices can thus be used as another means to attract children and enhance the realism of the surface treatment 10. Moreover, certain vinyl paints are electrically conductive so that electrically-conductive patterns or traces can be printed or painted onto the outer surface 16 of one or more of the three-dimensional members 12. The traces can be used to electrically support the interactive devices and displays.

As shown in the drawings, the three-dimensional member 12, preferably made of relatively soft vinyl, is used to form a cover for a conventionally constructed book having a front 11 and a back 15 joined together by a spine 13. In the embodiment depicted in FIG. 1, the three-dimensional member 12 covers a significant portion of the front 11, the back 15 and spine 13 of the book. The shape of the three-dimensional member 12 further defines the shape of the three-dimensional appearance of the surface treatment 10. That is, the three-dimensional member 12 can be shaped or sculpturally molded in the form of any object, such as a rock, bricks formed into a wall, parts of a tree, mountains, clouds and the like. Thus, if the three-dimensional member 12 is molded in the form of a tree, the surface treatment 10 would include three-dimensional objects, such as branches and leaves, that affect the length and height of the surface treatment 10. Therefore, as the shape of the three-dimensional member 12 changes, so does the terrain or shape of the surface treatment 10. Accordingly, changing the shape of the three-dimensional member 12 can be advantageously used to alter the appearance of the cover for the book.

Figure 2:
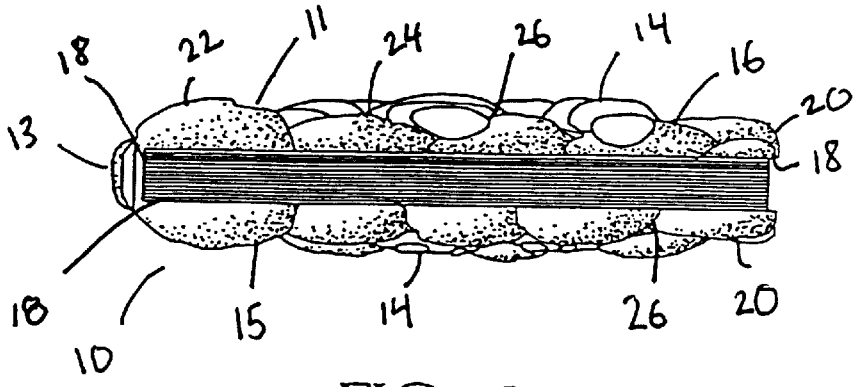
FIG. 2 is a side view of the outer surfaces of the cover shown in FIG. 1.

As illustrated in FIGS. 1 and 2, the three-dimensional member 12 includes an outer surface 16, an inner surface 18 and a border 20. The three-dimensional member 12 can be made from any type of material, although soft plastic material, such as vinyl, with a low durometer range, is preferred. Plastic material with a relatively low durometer will be flexible enough so that it can be deformed, yet retain its three-dimensional appearance. This is particularly important when the material will be deformed or bent frequently, such as in the case of a cover for a book as shown in the drawings herein.

As further illustrated in FIG. 2, the combination of the three-dimensional member 12 and inserts 14 help to define the three-dimensional sculpture-in-the-round appearance of the surface treatment 10. As shown, the surface treatment 10 represents rocks, an eye and a hand appearing to emerge from the rocks. The thickness, height and detail of the surface treatment 10 can be observed from all sides. The height of the surface treatment 10 will be generally defined by the thickness of the three-dimensional member 12 and the inserts 14. It should be understood that the inserts 14 can be replaced by additional three-dimensional members 12 that are sculpturally molded into similar shapes and designs.

Figure 3:
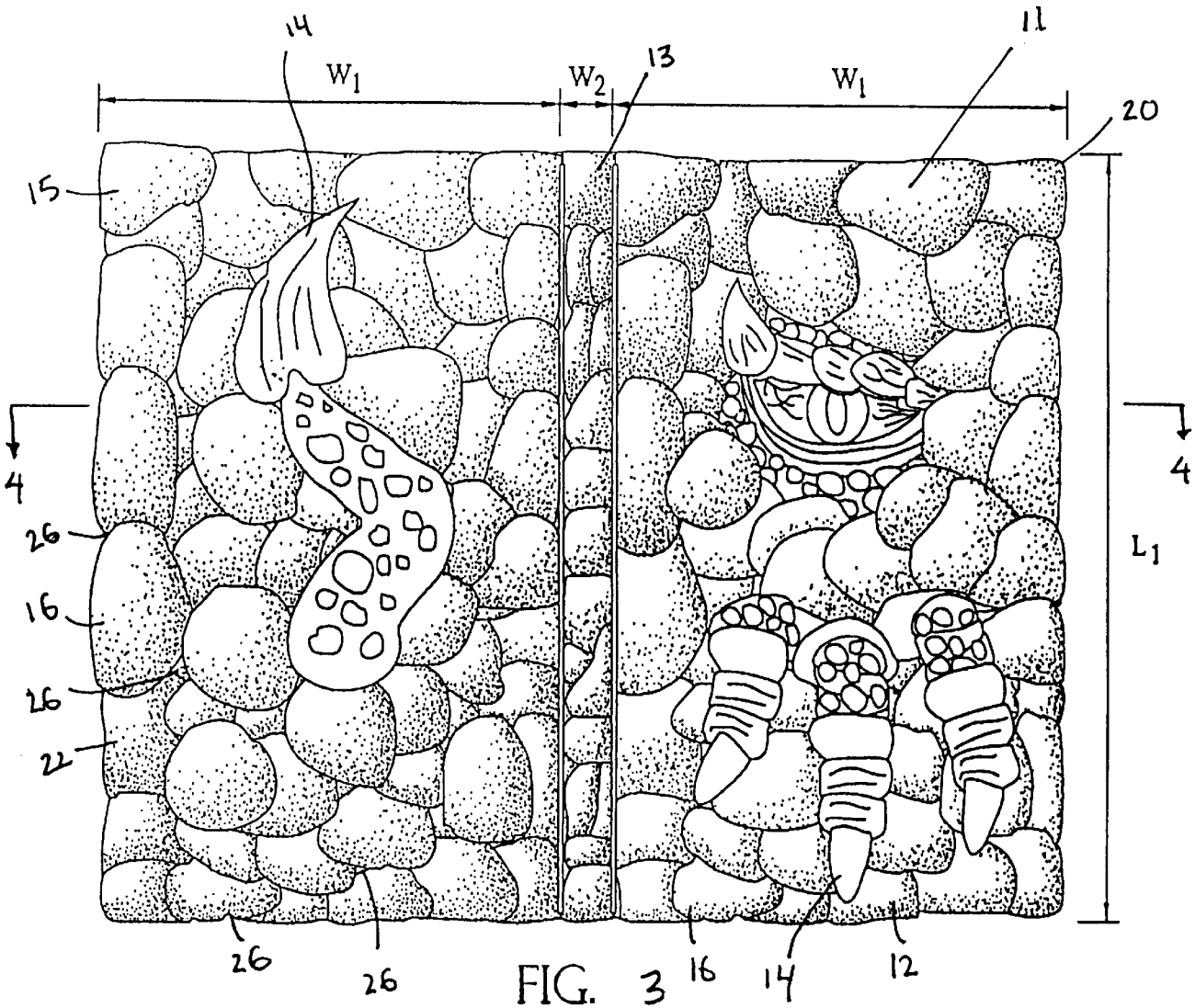
FIG. 3 is a plan view of the outer surface of the cover shown in FIG. 1, with the book in an open position.

Turning now to FIG. 3, the book is shown in an open position such that the front 11 and back 15 of the book are essentially side-by-side. As shown, the three-dimensional member 12 covers the front 11 and back 15 equally, having the same relative dimensions in terms of length $L_1$ and width $W_1$, with the spine 13 having a width $W_2$. The dimensions of the three-dimensional member 12 should be slightly larger than the leaves of the book in order to protect them from damage. In addition, the larger dimensions of the three-dimensional member 12 will allow the book to be easily opened.

As shown in FIGS. 2 and 3, the outer surface 16 of the three-dimensional member 12 is sculpturally formed into a three-dimensional design. The outer surface 16 can be formed using conventional processes such as casting, molding, thermoforming and the like. Preferably, the process used should allow the formation of predetermined undercuts or relieved surfaces to enhance the realism of the design. The outer surface 12 is defined by a plurality of peaks 22, impressions 24 and undercuts or relieved surfaces 26, in all axes, having substantial or predetermined detail to increase the overall dimensionality of the surface treatment 10. Particularly, the undercuts 26 are useful in creating shadows and overhanging areas that are typically present in most three-dimensional objects. As illustrated in FIGS. 2 and 3, the peaks 22, impressions 24 and undercuts 26 contribute toward the three-dimensional appearance of the surface treatment 10.

The outer surface 16 can be painted or coated with any desired colors or texture. Specific areas of the outer surface 16 or the inserts 14 can be painted with different colors, include pictures or other types of graphic illustrations to further enhance the realism of the surface treatment 10. There are a number of vinyl paints available that are easily applied to a vinyl surface.

As another advantage of the present invention, using soft plastic material such as vinyl allows the three-dimensional member 12 to be impregnated or coated with other objects and particles. For instance, particles can be added to the three-dimensional member 12 or the outer surface 16 to create many effects, such as the look of rock.

Figure 4:
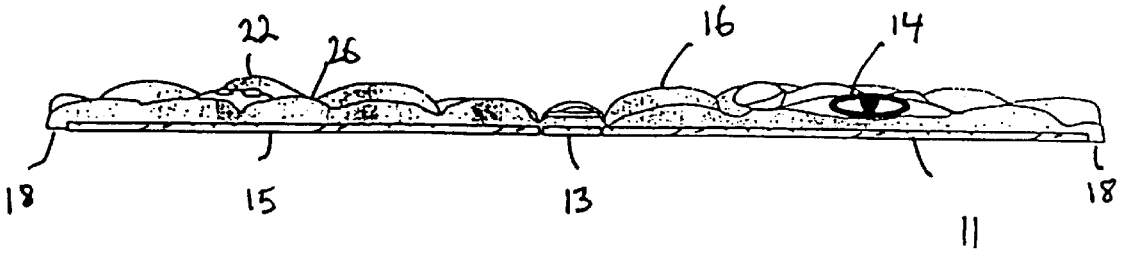
FIG. 4 is a side view of the cover shown in FIG. 3, taken along line 4—4.

Turning now to FIG. 4, a portion of the inner surface 18 is shown in section. The inner surface 18 is flat so that it can be adhered to a portion of the front surface 11 and back surface 15 of the book using conventional means, such as adhesives. The portion of the inner surface 18 that covers the spine 13 preferably is not adhered to the spine 13, so that it can bend when the book is opened or closed.

It is contemplated that the inner surface 18 can have any shape or form that is required to mount the surface treatment 10 to an underlying object or substrate. Accordingly, it is within the scope of the invention that the inner surface 18 can be molded or shaped to mate with a surface having any type of texture or contour, including a surface similar to the outer surface 16 shown in FIG. 2. In the embodiment shown in FIG. 4, the inner surface 18 is recessed so that the borders 20 of the three-dimensional member 12 wrap around the front 11 and back 15 of the book. This helps to locate the book within the surface treatment 10.

Figure 5:
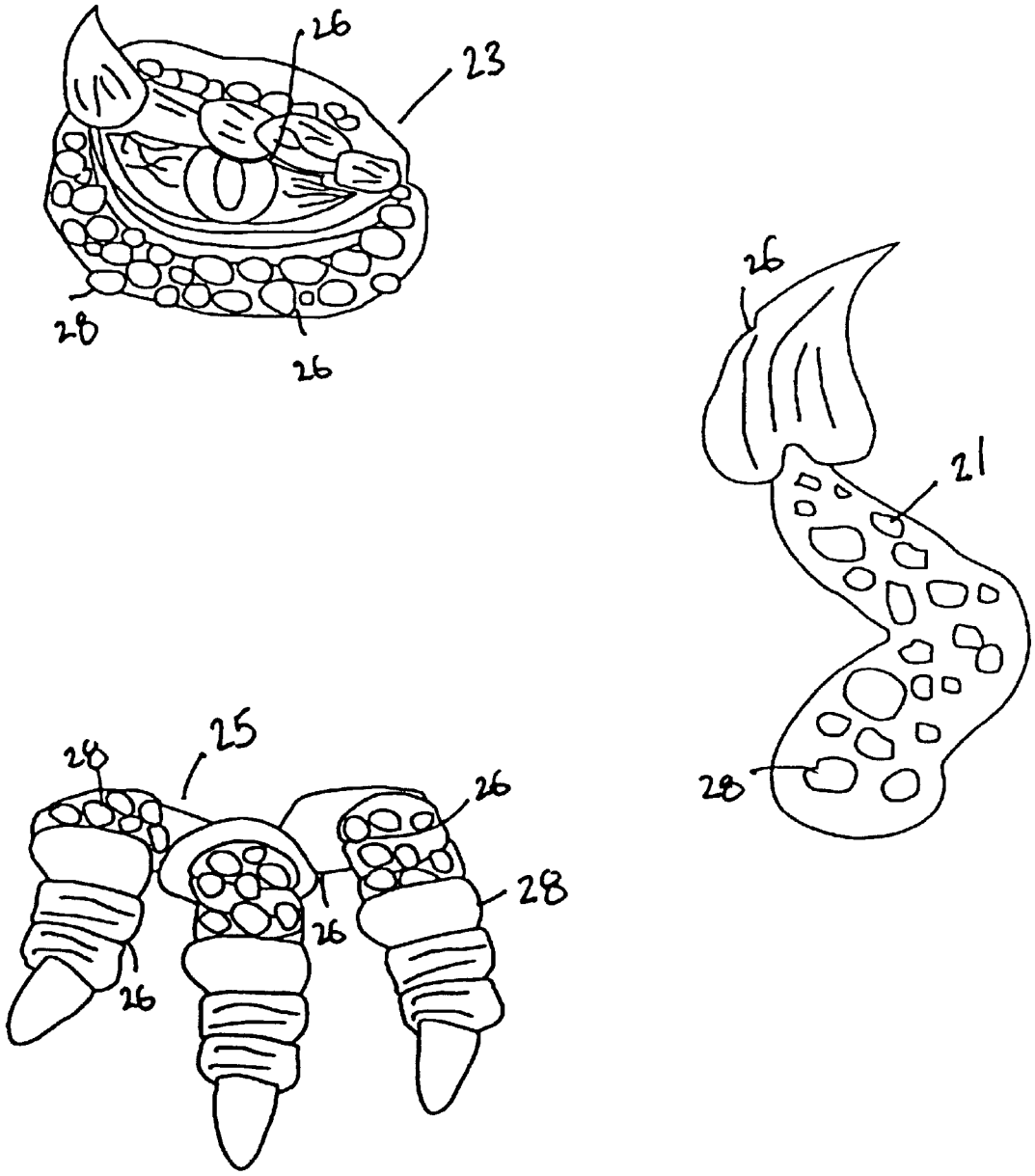
FIG. 5 illustrates a plurality of three-dimensional inserts adapted for use with the cover shown in FIG. 1.

Referring now to FIG. 5, the inserts 14 as seen in FIG. 1 are shown individually. The inserts 14 are in the form of a tail 21, an eye 23 and a hand 25. The inserts 14 are molded as separate three-dimensional parts or layers and may be created using the same techniques used to create the three-dimensional design of the outer surface 16 of the three-dimensional member 12. The inserts 14 can be made of vinyl, or can be made from other materials such as polyurethane, PVC or the like. The inserts 14 are preferably, but not necessarily, thematically related to the book or the surface treatment 10. Each of the inserts 14 shown in FIG. 5 have peaks 28 and undercuts 30 to provide a three-dimensional appearance. When applied to the three-dimensional member 12, the inserts 14 create an additional three-dimensional layer and further enhance the sculpture-in-the-round appearance of the surface treatment 10.

Furthermore, each of the inserts 14 can be painted or coated with any desired colors and texture. For example, the area surrounding eye 23 can be painted with highlights and darker areas to vary the look of the surface. The eye 23 can also be molded to accommodate an acrylic pupil embedment that is inserted from behind. All of these features create a three-dimensional appearance that has a very realistic look.

Figure 6:
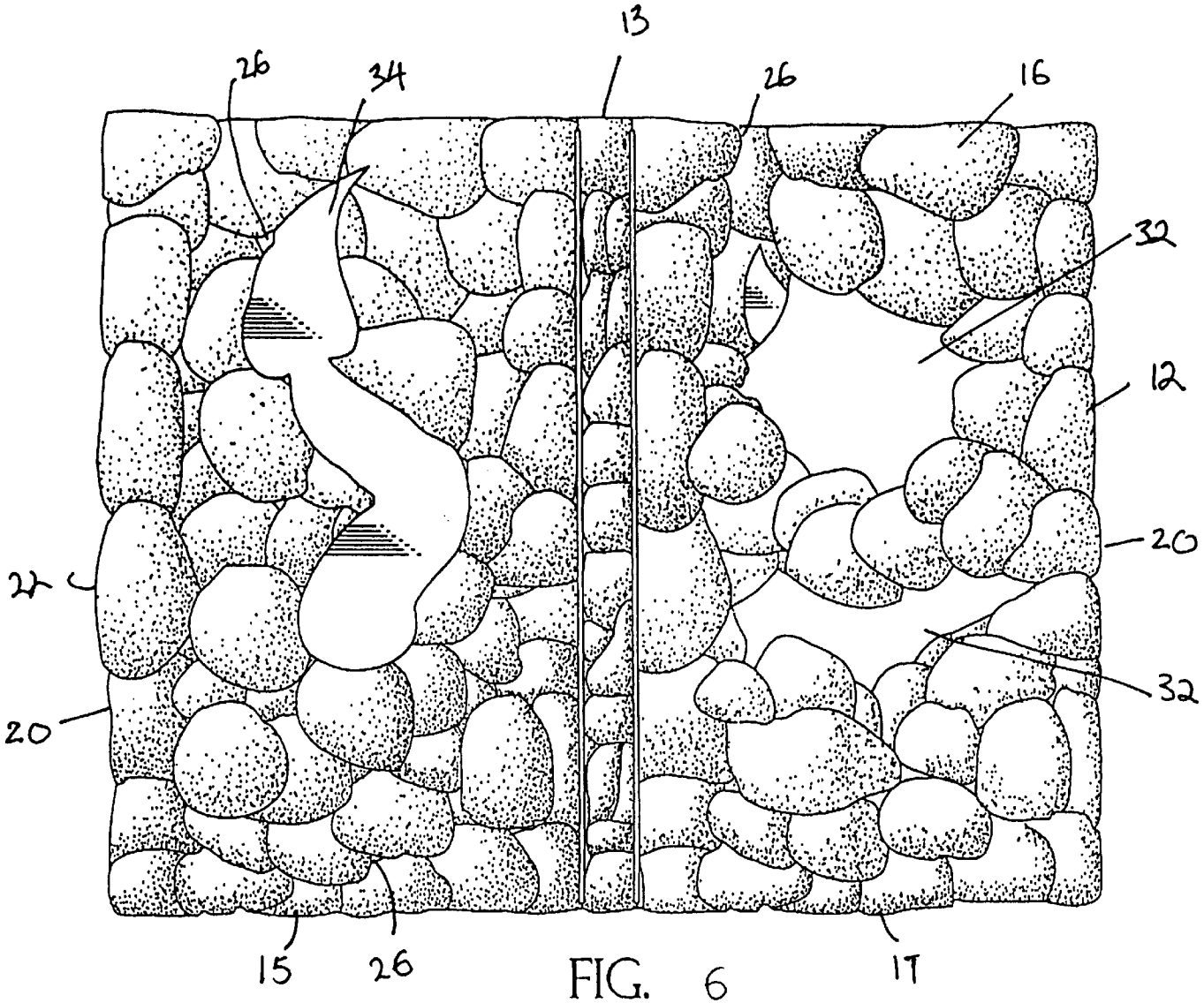
FIG. 6 is a plan view of the outer surface of the cover shown in FIG. 3, showing a recess and openings to receive the three-dimensional inserts shown in FIG. 5.

As shown in FIG. 6, a plurality of openings 32 and a recess 34 can be formed within or on the three-dimensional member 12 to receive the inserts 14. The openings 32 are dimensioned to mate with an insert 14 having a corresponding shape. The openings 32 can be formed by die-cutting or can be formed during molding. The recess 34 is also shaped to mate with an insert 14 having a corresponding shape and can also be created during molding. Both the recess 34 and the openings 32 should be slightly smaller than the corresponding shape of the insert 14 so that the insert 14 is held firmly within the surface treatment 10, without the need for adhesive material. However, adhesives can be used if desired.

Figure 7:
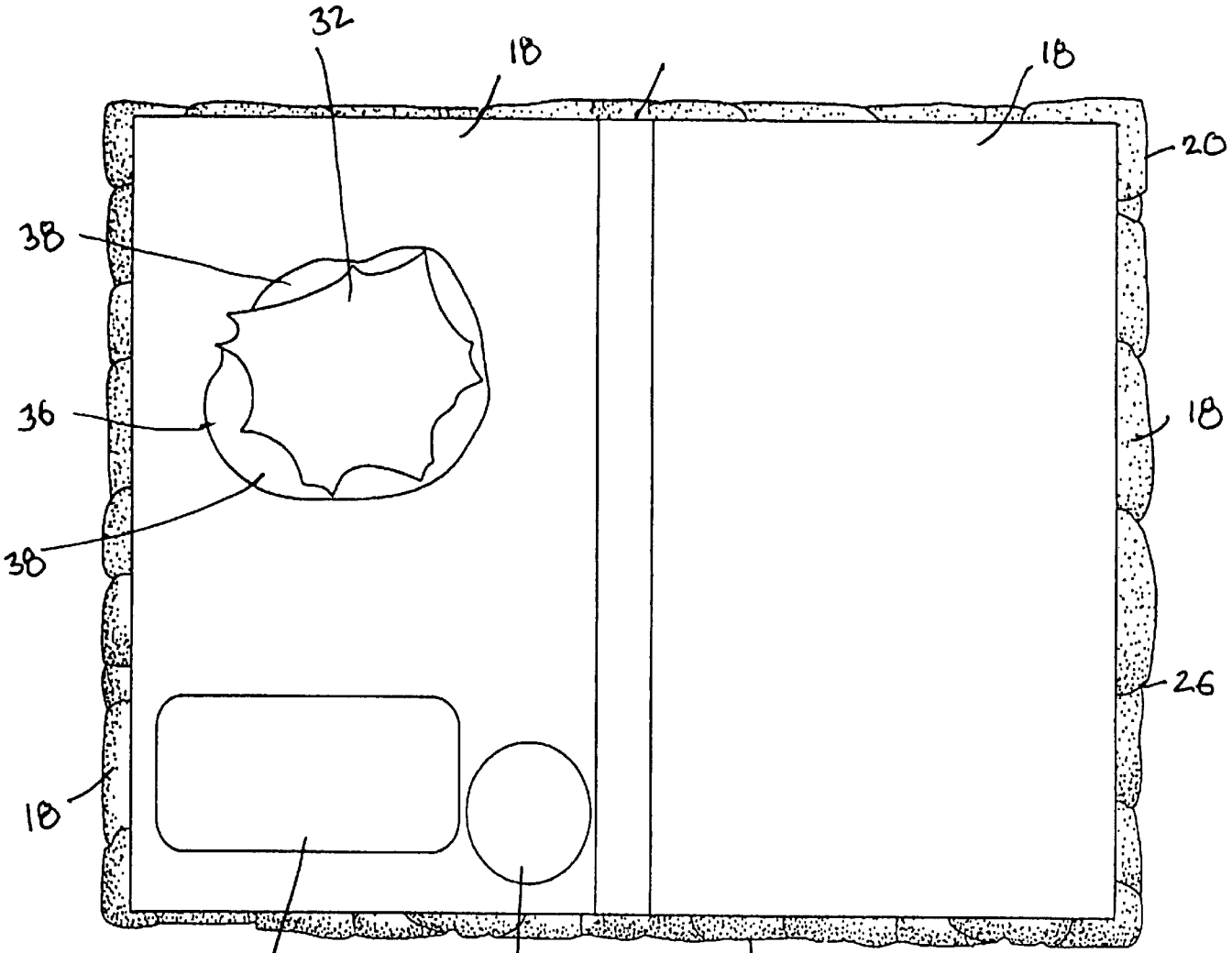
FIG. 7 is a plan view of the inner surface of the cover shown in FIG. 6.

FIG. 7 is helpful in illustrating the configuration of the openings 32 depicted in FIG. 6. The opening 32 for the eye is shown as representative.

As shown, the opening 32 opens into the inner surface 18 of the three-dimensional member 12. The shape of the opening 32 will be generally defined by the three-dimensional member 12 as well as the insert 14. Thus, if the outer surface 16 of the three-dimensional member 12 has curved surfaces, the curved surfaces may project into the opening 32 as shown in FIG. 7.

A recessed portion 36 may be formed in the inner surface 18 around a portion of the opening 32. The recessed portion 36 is provided so that the inserts 14 that projects through the opening 32 will be substantially flush with the inner surface 18. As a result, the insert 14 will not interfere with the closing of the front 11 of the book.

As further illustrated in FIG. 7, additional recessed portions 40 can be molded into the inner surface 18. The recessed portions 40 can be shaped and sized to accommodate objects such as a name plate, playing cards or interactive devices that include a speaker or a printed circuit board. The recessed portions 40 should be deep enough so that an object mounted in the recessed portion 40 will not interfere with the closing of the book.

Figure 8:
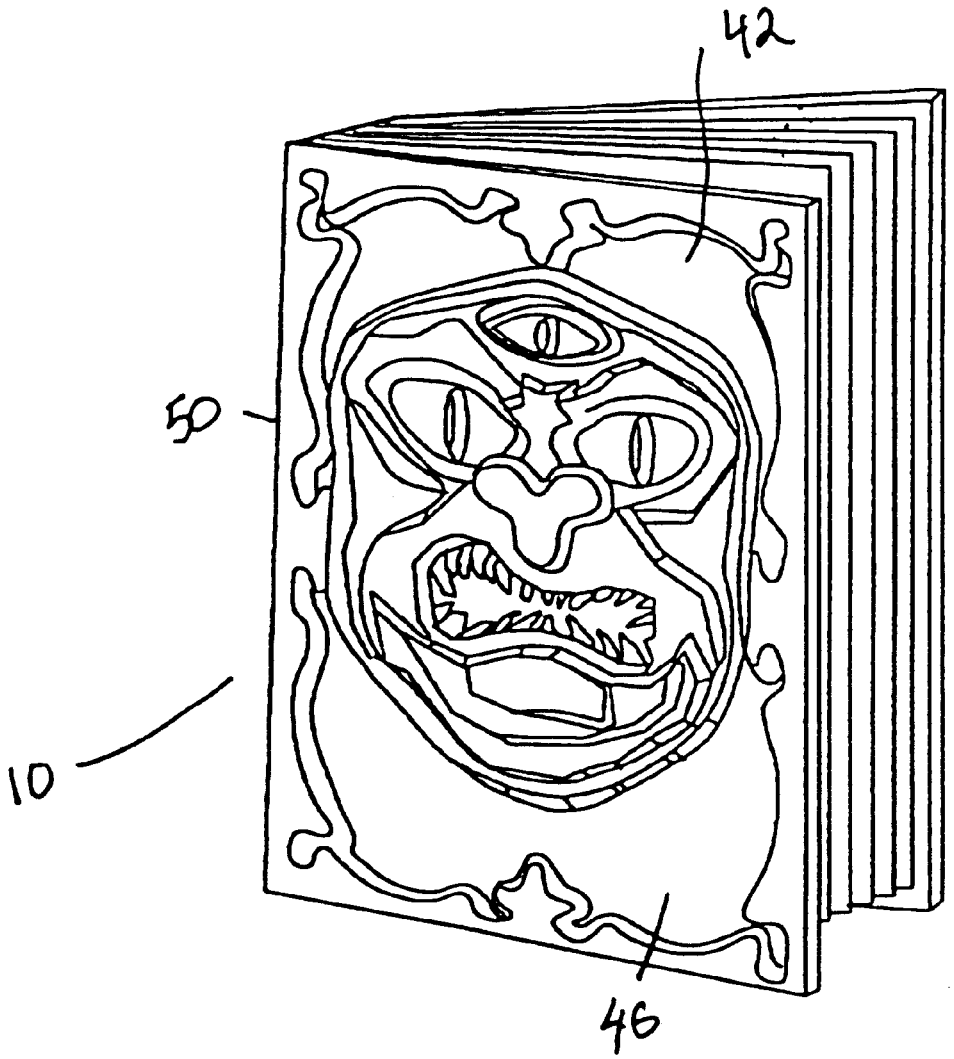
FIG. 8 is an isometric view of an alternative embodiment a three-dimensional surface treatment comprising a plurality of layers formed into a cover for a book.
Figure 9:
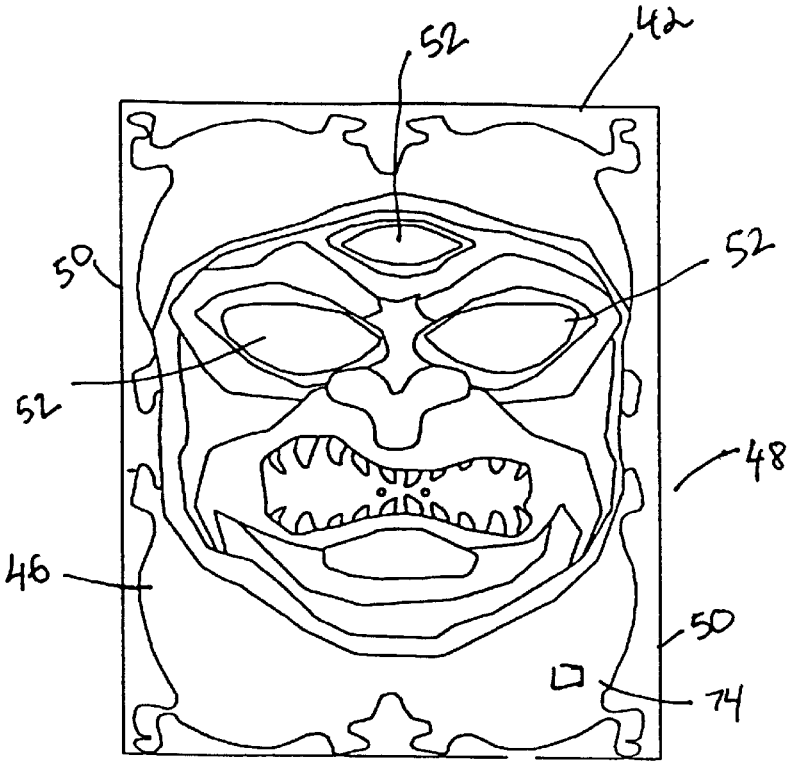
FIG. 9 is a plan view of the outer surface of a first layer of the cover shown in FIG. 8.
Figure 10:
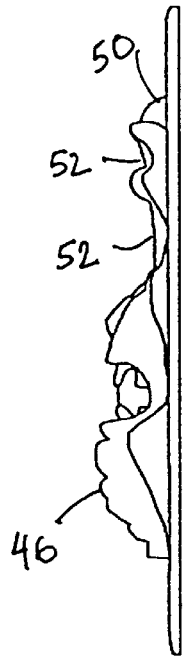
FIG. 10 is a side view of the layer shown in FIG. 9.
Figure 11:
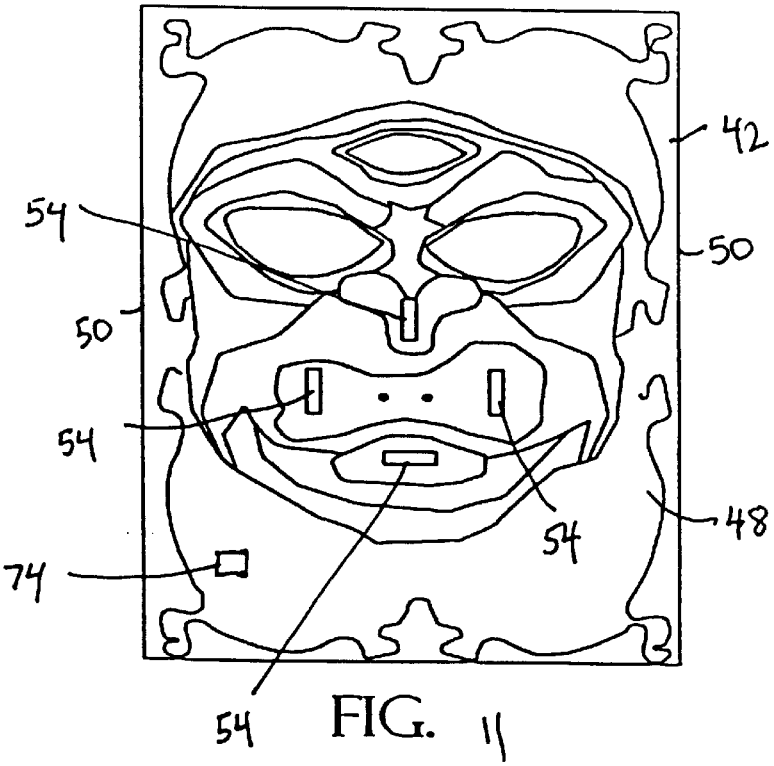
FIG. 11 is a plan view of the inner surface of the first layer of the cover shown in FIG. 9.
Figure 12:
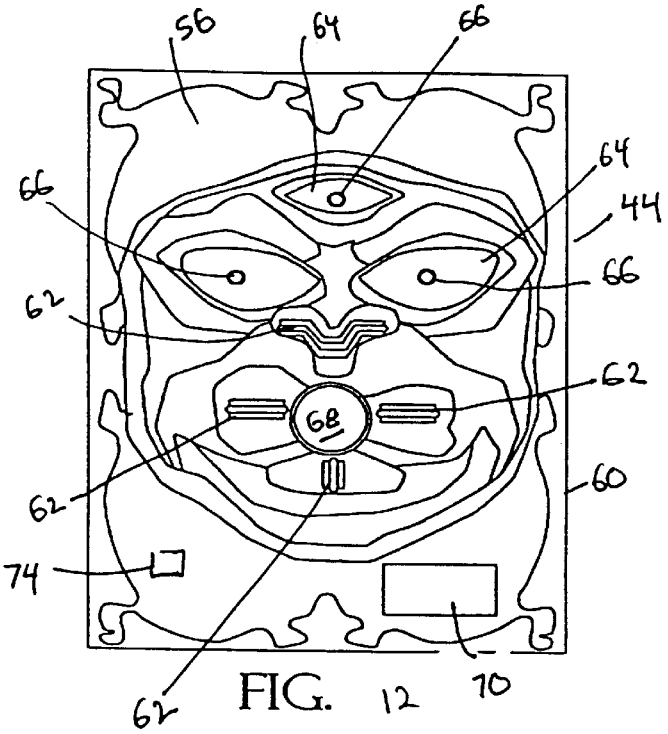
FIG. 12 is a plan view of the outer surface of a second layer of the cover shown in FIG. 9, wherein the second layer is placed under the first layer.
Figure 13:
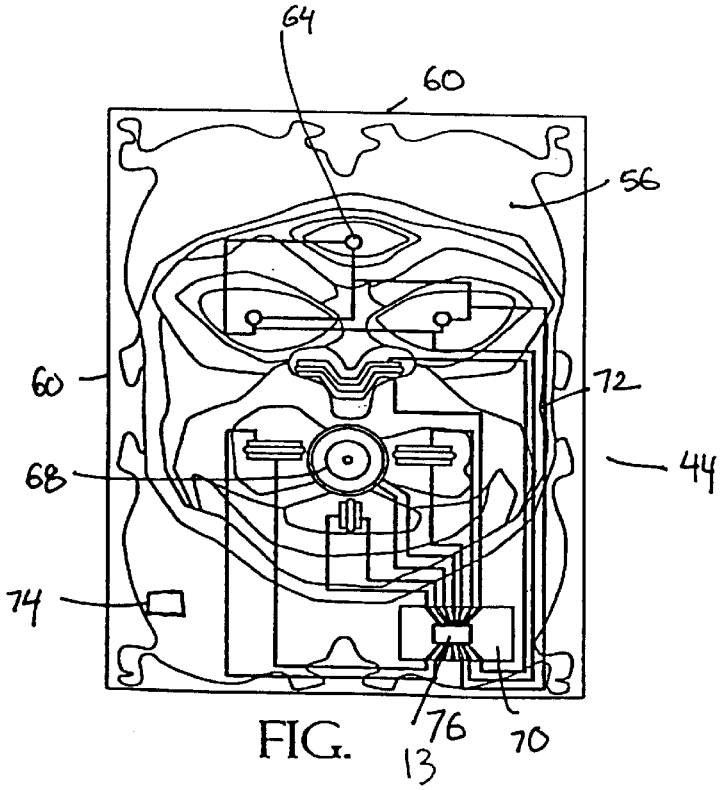
FIG. 13 is a plan view of the outer surface of the second layer of the cover shown in FIG. 9, having a printed circuit thereon.

Turning now to FIGS. 8 through 13, an alternative embodiment of the present invention is shown. FIG. 8 illustrates the surface treatment 10 molded in an alternative form of a cover for a book. The surface treatment 10 comprises a first layer 42 and a second underlying layer 44 (as seen in FIGS. 12 and 13) joined to one another to form a face. The first layer 42 is preferably, but not necessarily, made of vinyl molded in the form of a shell approximately 2 mm thick or any thickness so desired. As best seen in FIG. 9, the first layer 42 includes an outer surface 46, an inner surface 48 and a border 50. A plurality of die-cut openings 52 are provided on the first layer 42. Each of the die-cut openings 52 are shaped and dimensioned to receive inserts or other interactive devices, such as an acrylic eye, for example.

As shown in FIG. 10, the outer surface 46 is molded into a three-dimensional surface treatment having predetermined detail, texture and undercuts to create a sculpture-in-the-round appearance. The outer surface 46 can be painted or coated with vinyl paints or coatings, as desired, to further enhance the three-dimensional appearance.

Turning now to FIG. 11, the inner surface 48 of the first layer 42 is shown. The inner surface 48 is molded in the form of a face, having a contour similar to that of the outer surface 46. The inner surface 48 generally defines the interior space of the shell. The inner surface 48 includes conductive ink 54 located within the mouth, chin and nose. The conductive ink 54 may be painted or screen printed on the inner surface 48. It should be understood that the conductive ink 54 can be printed or painted in the form of a circuit that is used to support various interactive devices, as discussed below.

Turning now to FIGS. 12 and 13, the second layer 44 is shown. The second layer 44 is correspondingly shaped and dimensioned to fit underneath the first layer 42. Similar to the first layer 42, the second layer 44 may be molded in the form of a shell that is approximately 2 mm thick, or it can be solid, whichever is desired. It should be understood that the second layer 44 or any three-dimensional member 12 can be molded to have any type of thickness. The second layer 44 may be made from vinyl or any other type of material, such as PVC.

As illustrated in FIG. 12, the second layer 44 includes an outer surface 56, an inner surface (not shown) and a border 60. The outer surface 56 is molded to mate with the inner surface 48 of the first layer 42. Positioned on the outer surface 56 are a plurality of conductive ink contact points 62. The contact points 62 are positioned on the outer surface 56 in order to contact the conductive ink 54 on the inner surface 48 of the first layer 42.

The inner surface of the second layer 44 defines an interior space of the shell. Preferably, the interior space is filled with filler material such as wood pulp, EVA foam plastic, paper or the like, to help support the shell.

Interactive devices 64 are associated with the second layer 44 to enhance the interactive nature of the surface treatment 10. The interactive devices 64 can be any type of device, circuit, or mechanism that can be seen, heard, or felt on the outer surface 46 of the first layer 42. Furthermore, the interactive devices 64 should be adapted to respond to external stimuli, such as when key areas of the first layer 42 are touched. For example, the conductive ink 54 can be molded into a circuit that is electrically linked to or associated with a power source and include a switch. The switch may be in the form of a button or other means for closing the circuit that is activated by the user. As one example of a switch, the conductive contact points 62 may be spaced away from, but in registry with each other. In such an embodiment, the circuit lines can be bridged by the touch of a finger such that the moisture in the finger closes the circuit. Thus, children can touch a certain area to control when certain interactive displays are activated.

In the embodiment shown in FIG. 12, the interactive devices 64 include light emitting diodes (LEDs) 66 and a speaker 68. The LEDs 66 are molded into the outer surface 56 of the second layer 44. The LEDs 66 are placed where the three eyes are formed in order to give the appearance of glowing eyes when activated. The speaker 68 is located in the mouth of the outer surface 56 and may emit sounds, music, words, phrases or the like.

An insert 70 is positioned on the outer surface 56. The insert 70 is provided to receive a printed circuit board (PCB), a processor, or other electronic means to control the interactive devices 64.

Turning now to FIG. 13, the second layer 44 is shown with an electric circuit 72. The circuit 72 can be painted or screen printed onto the outer exposed surface 56 of the second layer 44 using electrically conductive vinyl paint or electrically conductive plastic as just two examples. The circuit 72 is connected to a power source (not shown). The circuit 72 is used to interconnect the interactive devices 64 and the electronic means for controlling them.

In the embodiment shown, the circuit 72 interacts with the contact points 62 and the conductive ink 54. When certain areas of the outer exposed surface 46 of the first layer 42 are pushed or pressed, the conductive ink 54 will engage the contact points 62. Once the contact points 62 are engaged, electricity can flow from the power source to the interactive devices 64.

In an alternative embodiment, sensors 74 can be used to activate the interactive devices 64. The sensors 74 can be embedded into either the outer or inner surfaces of the either the first layer 42 or the second layer 44. The sensors 74 can be positioned to respond to external physical stimuli, such as the moisture or heat from a hand or finger, vibrations, the change in the intensity of light or the like. The sensors 74 can generate a signal that is relayed to a processor 76. The processor 76 will convert the signal to electronic impulses or signals that control the interactive devices 64. Other means for activating and controlling the interactive devices 64 can be used in keeping with the scope of the present invention.

Figure 14:
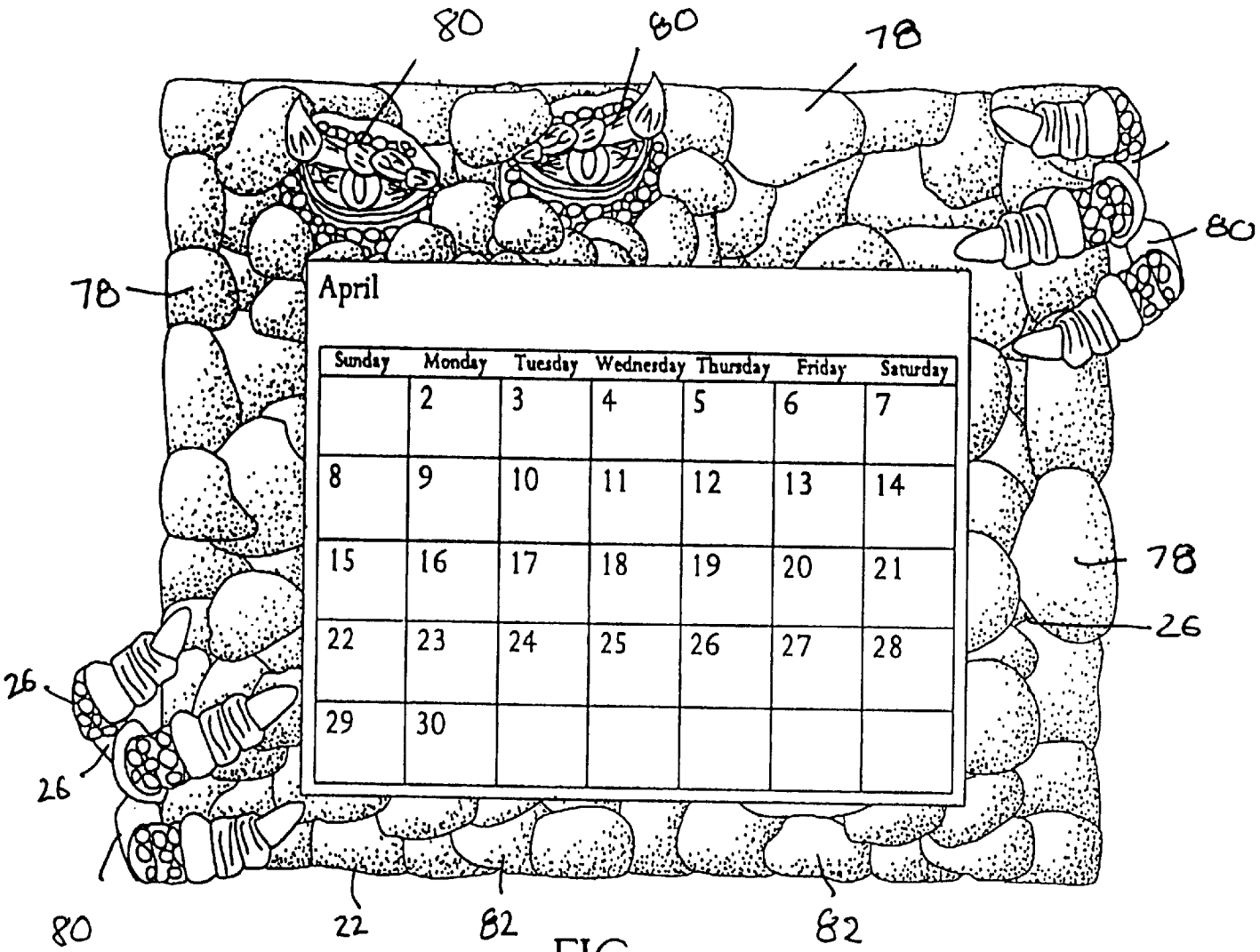
FIG. 14 illustrates an alternative embodiment of a three-dimensional surface treatment in accordance with present invention.

FIG. 14 illustrates another alternative embodiment of the present invention. As shown, the three-dimensional surface treatment 10 is molded in the form of a calendar. Of course, the surface treatment 10 can be mounted on a diary, a desk pad, or applied to other objects. The surface treatment 10 includes a base layer 78 and a plurality of inserts 80. The base layer 78 is molded into a three-dimensional sculpture-in-the-round having an outer surface 82 that is molded to accommodate a calendar. The outer surface 82 can be painted or coated as desired.

The inserts 80 are in the form of a pair of eyes and hands located on the base layer 78. The eyes are located along the upper portion of the base layer 78 and the hands are located at corners of the calendar, diagonally across from one another. The hands are curved to give a three-dimensional appearance that they are holding the calendar.

Figure 15:
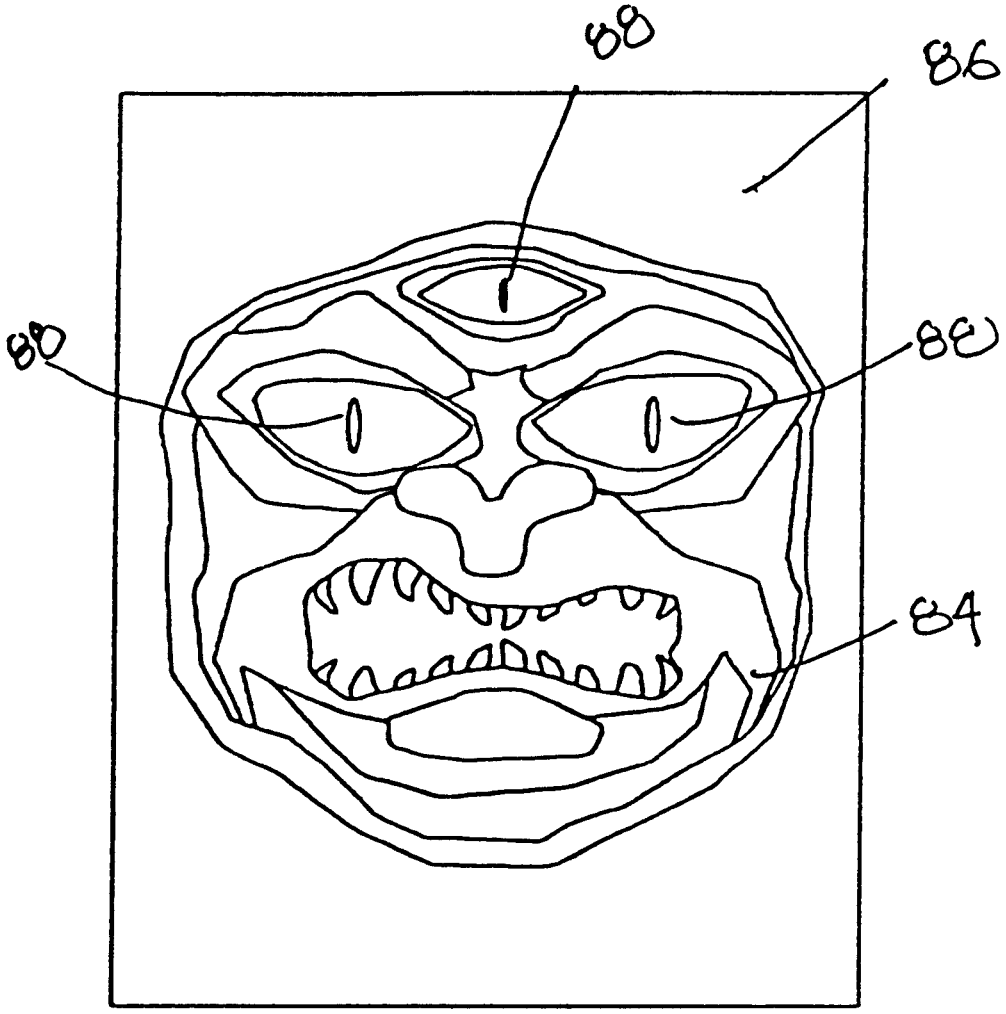
FIG. 15 illustrates another alternative embodiment of the three-dimensional surface treatment in accordance with present invention.

FIG. 15 illustrates the surface treatment 10 molded in the form of a poster. The surface treatment 10 includes at least one three-dimensional member 84 that is formed into a three-dimensional sculpture in the round. The three-dimensional member 84 can be in the form of a shell having an outer surface and an inner surface. The inner surface can define an interior space that is filled with filler material, such as pulp, paper, EVA foam plastic, or the like. Similar to the previous embodiments, the three-dimensional member 84 can be colored or molded to include graphic indicia to enhance the three-dimensional appearance. The three-dimensional member 84 is secured to a substrate 86, such as paper, a wall, fabric, or the like. The surface treatment 10 also includes a plurality of non-electrical interactive devices or inserts 88 such as optical fibers, light reflecting material, light emitting material or the like. Of course, other types of interactive devices, such as LEDs or speakers, can be used.

It is anticipated, based upon the description of the invention above, that the surface treatment 10 can be used in a variety of applications, besides books. The surface treatment 10, having at least one or multiple three-dimensional members 12, may be applied to any type of substrate that is desired. Also, the substrate may be in any form such as posters, wallpaper, point of sale packaging, gift boxes, folders, gift cards, decorative panels for garments, and other articles of clothing, as a few examples.

The present invention may be embodied in other specific forms without departing from the spirit or essential attributes thereof and, accordingly, reference should be made to the appended claims, rather than to the foregoing specification, as indicating the scope of the invention.

I claim:

1. A tree-dimensional molding for attachment to a substrate comprising:

at least one three-dimensional member having an outer surface, an inner surface, and a border, the outer surface being molded from a flexible material to present a sculpturally formed three-dimensional design having predetermined detail, texture, and undercuts to create a sculpture-in-the-round appearance, and wherein the inner surface is to be adhered to the substrate.

2. The surface treatment as claimed in claim 1, wherein the at least one three-dimensional member supports at least one interactive device.

3. The surface treatment as claimed in claim 1, wherein the at least one three-dimensional member is made from plastic.

4. The surface treatment as claimed in claim 3, wherein the plastic is vinyl.

5. The surface treatment as claimed in claim 1, wherein the at least one three-dimensional member is made from a pliant material.

6. The surface treatment as claimed in claim 1, wherein the at least one three-dimensional member is sculpturally formed by molding.

7. The surface treatment as claimed in claim 1, wherein the outer surface of the at least one three-dimensional member is colored to enhance the three-dimensional appearance of the surface treatment.

8. The surface treatment as claimed in claim 1, wherein the at least one three-dimensional member comprises a plurality of three-dimensional layers, each having an outer surface sculpturally molded and shaped into a predetermined three-dimensional design having predetermined detail, texture, and undercuts to create a sculpture-in-the-round appearance.

9. The surface treatment as claimed in claim 8, wherein the three-dimensional layers support at least one interactive device.

10. The surface treatment as claimed in claim 8, wherein each of the three-dimensional layers is made from a different material.

11. A three-dimensional molding for attachment to a book having a front, a back, and a spine, the molding comprising:

a three-dimensional member to cover at least a portion of the book, the three-dimensional member having an outer surface, an inner surface, and a border, the outer surface being molded from a flexible material to present a sculpturally formed three-dimensional design having predetermined detail, texture, and undercuts in each axis to create a sculpture-in-the-round.

12. The surface treatment as claimed in claim 11, wherein the three-dimensional member is made from plastic material.

13. The surface treatment as claimed in claim 12, wherein the plastic material has a durometer in the range from about 20 to 60.

14. The surface treatment as claimed in claim 12, wherein the plastic material is vinyl.

15. The surface treatment as claimed in claim 11, wherein the outer surface of the three-dimensional member is colored to enhance the three-dimensional appearance of the surface treatment.

16. The surface treatment as claimed in claim 11, wherein the three-dimensional member supports an interactive device.

17. The surface treatment as claimed in claim 16, wherein the interactive device is embedded below the outer surface of the three-dimensional member.

18. The surface treatment as claimed in claim 17, further comprising an electronic circuit supported by the three-dimensional member and associated with the interactive device.

19. The surface treatment as claimed in claim 18, wherein the interactive device is activated by a switch associated with the circuit.

20. The surface treatment as claimed in claim 16, wherein the interactive device responds to external stimuli.

21. The surface treatment as claimed in claim 11, wherein the three-dimensional member is formed into a shell having an interior space defined by the inner surface, the border, and the book.

22. The surface treatment as claimed in claim 11, wherein the three-dimensional member is molded to cover the front, back, and spine of the book.

23. The surface treatment as claimed in claim 11, wherein the three-dimensional member includes indicia on the outer surface to enhance the three-dimensional appearance of the surface treatment.

24. The surface treatment as claimed in claim 11, further comprising a plurality of inserts associated with the three-dimensional member, each insert forming part of the three-dimensional appearance of the surface treatment.

25. The surface treatment as claimed in claim 11, further comprising a plurality of interactive devices supported by the three-dimensional member.

26. An interactive three-dimensional molding for attachment to a substrate comprising:

a first layer formed into a three-dimensional shape, the first layer having an outer surface, an inner surface and a border, the outer surface being molded from a flexible material to present a sculpture-in-the-round;

a second layer underlying and shaped and dimensioned to mate with the first layer, the second layer having an outer surface, an inner surface, and a border, the inner surface of the second layer being applied to a substrate; and at least one interactive device supported by a selected one of the first and second layers.

27. The three-dimensional surface treatment as claimed in claim 26, wherein the surface treatment is a calendar.

28. The three-dimensional surface treatment as claimed in claim 26, wherein the surface treatment is a poster.

29. The three-dimensional surface treatment as claimed in claim 26, wherein the surface treatment is molded into a cover for a book.

* * * * *